US006059629A

United States Patent [19]

Lin

[11] Patent Number: 6,059,629

[45] Date of Patent: May 9, 2000

[54] STRUCTURE OF BUBBLE BLOWING TOY

[76] Inventor: Mon-Sheng Lin, 5th Fl., No. 4, Lane 7, Pao Kao Road, Hsintien, Taipei Hsien, Taiwan

[21] Appl. No.: 09/166,715

[22] Filed: Oct. 5, 1998

[51] Int. Cl.[7] ..... A63H 33/28

[52] U.S. Cl. ..... 446/15

[58] Field of Search ..... 446/15, 16, 17, 446/18, 19, 20, 21

[56] References Cited

U.S. PATENT DOCUMENTS 5,183,428 2/1993 Lin ..... 446/15

5,653,620 8/1997 Lin ..... 446/15

*Primary Examiner*—Robert A. Hafer

*Assistant Examiner*—Urszula M. Cegiulnik

*Attorney, Agent, or Firm*—Dougherty & Troxell

[57] ABSTRACT

A bubble blowing toy includes a solution container holding a solution, and a bubble blowing device adapted to take up the solution from the solution container and to let the received solution be blowing into a big bubble, wherein the bubble blowing device has a hand grip at one end, an elongated solution take-up arm connected to the hand grip, and a shutter means pivoted to the solution take-up arm, the solution take-up arm having an elongated arm body with a longitudinally extended serrated portion and a neck connected between the arm body and the hand grip, the shutter means having two shutter arms, the shutter arms each having a first end respectively pivoted to two lugs at two opposite ends of the arm body of the solution take-up arm by a respective pivot and a second end pivoted to each other by a slip joint, which is formed of a longitudinal sliding slot at one shutter am and a fixed pivot pin at the other shutter arm.

5 Claims, 10 Drawing Sheets

STRUCTURE OF BUBBLE BLOWING TOY

BACKGROUND OF THE INVENTION

The present invention relates to a bubble blowing toy for blowing a solution into bubbles, and more particularly to a bubble blowing toy which is adapted to blow a solution into big bubbles.

A regular bubble blowing toy is generally comprised of a container holding a solution, and a bubble coil with a handle for blowing the solution into bubbles. Because the solution container is not convenient to be held by hand, the contained solution tends to be forced out of the solution container during playing. "Bubble Blowing Toy" of U.S. Pat. No. 5,183,428, which was issued to the present inventor, eliminates the aforesaid problem. According to U.S. Pat. No. 5,183,428, the bubble coil has the shape of a sword, and the solution container has the shape of a sheath adapted to receive the bubble coil. When the bubble coil is pulled out of the solution container and moved with the hand in the air, bubbles are produced. However, because the mouth of the sheath-like solution container is limited, the size of the bubble coil is limited too. In order to produce big bubbles, the size of the bubble coil must be relatively increased. "BUBBLE TOY WITH FLEXIBLE BUBBLE COIL" of U.S. Pat. No. 5,653,620, which is also an invention of the present inventor, provides a bubble toy with a flexible bubble coil. Because the bubble coil is flexible, it can be made having a relatively bigger size for blowing big bubbles.

SUMMARY OF THE INVENTION

The present invention provides a bubble blowing toy specifically designed for blowing a solution into big bubbles. According to one embodiment of the present invention, the bubble blowing toy comprises a solution container holding a solution, and a bubble blowing device adapted to take up the solution from the solution container and to let the received solution be blowing into a big bubble. The bubble blowing device comprises a hand grip at one end, an elongated solution take-up arm connected to the hand grip, and a shutter means pivoted to the solution take-up arm, the solution take-up arm comprising an elongated arm body and a neck connected between the arm body and the hand grip, the shutter means comprising two shutter arms coupled together, the shutter arms each having a first end respectively pivoted to two opposite ends of the arm body of the solution take-up arm by pivot means and a second end pivoted to each other by a slip joint. The arm body of the solution take-up arm and the shutter arms of the shutter means each have a serrated portion longitudinally disposed at an inner side for efficiently taking up the solution from the solution container. Alternatively, the arm body can be covered with a sleeve having a coarse outside wall, or an outside wall with grains on it.

DETAILED DESCRIPTION OF THE PREFERRED EMBODIMENT

Figure 1:
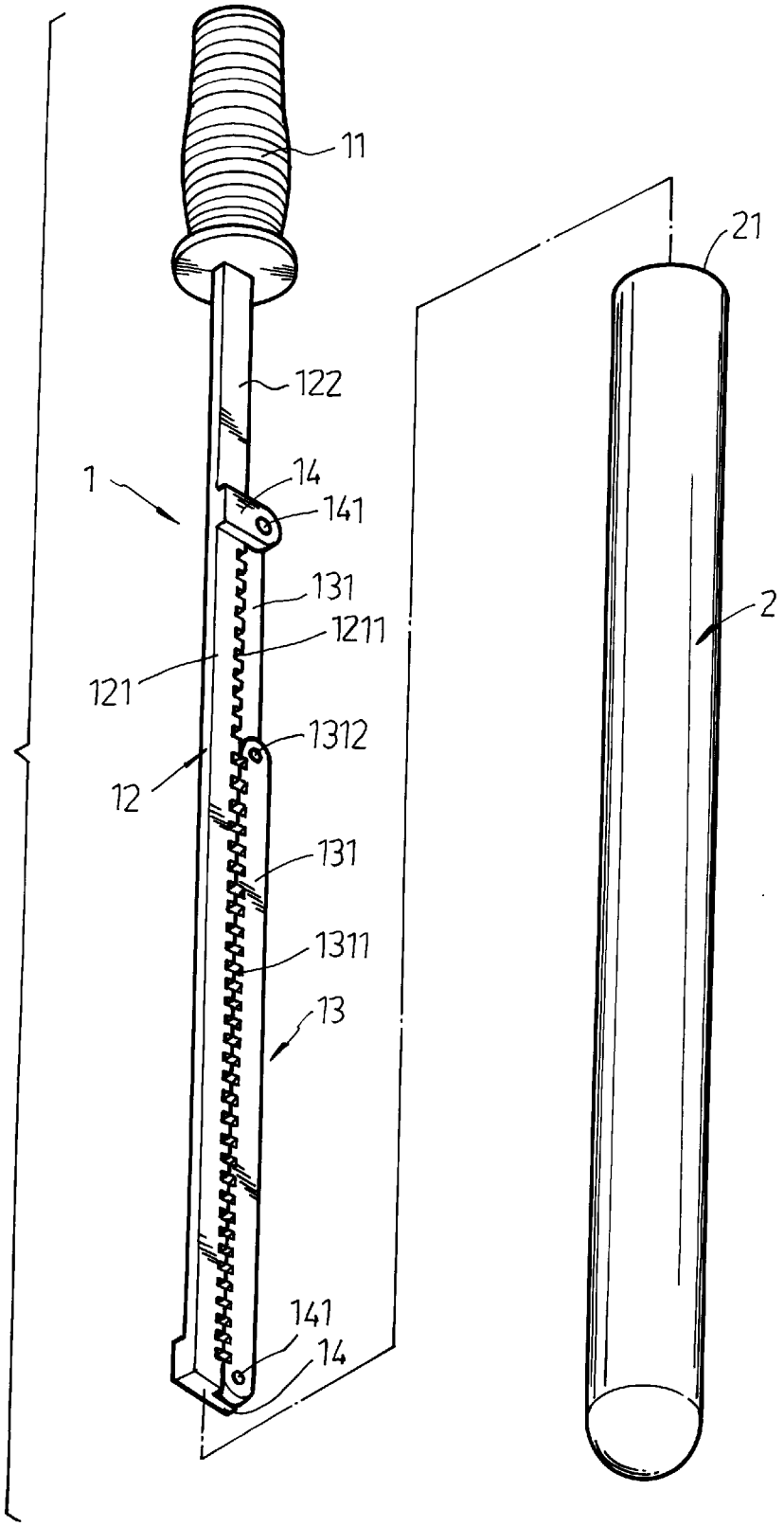
FIG. 1 is a perspective view of a bubble blowing toy according to a first embodiment of the present invention, showing the bubble blowing device removed from the solution container.

Referring to FIG. 1, a bubble blowing toy in accordance with the present invention is generally comprised of a bubble blowing device 1, and a solution container 2. The solution container 2 has an opening 21 at one end of the elongated container body thereof, and holds a solution on the inside.

Figure 2:
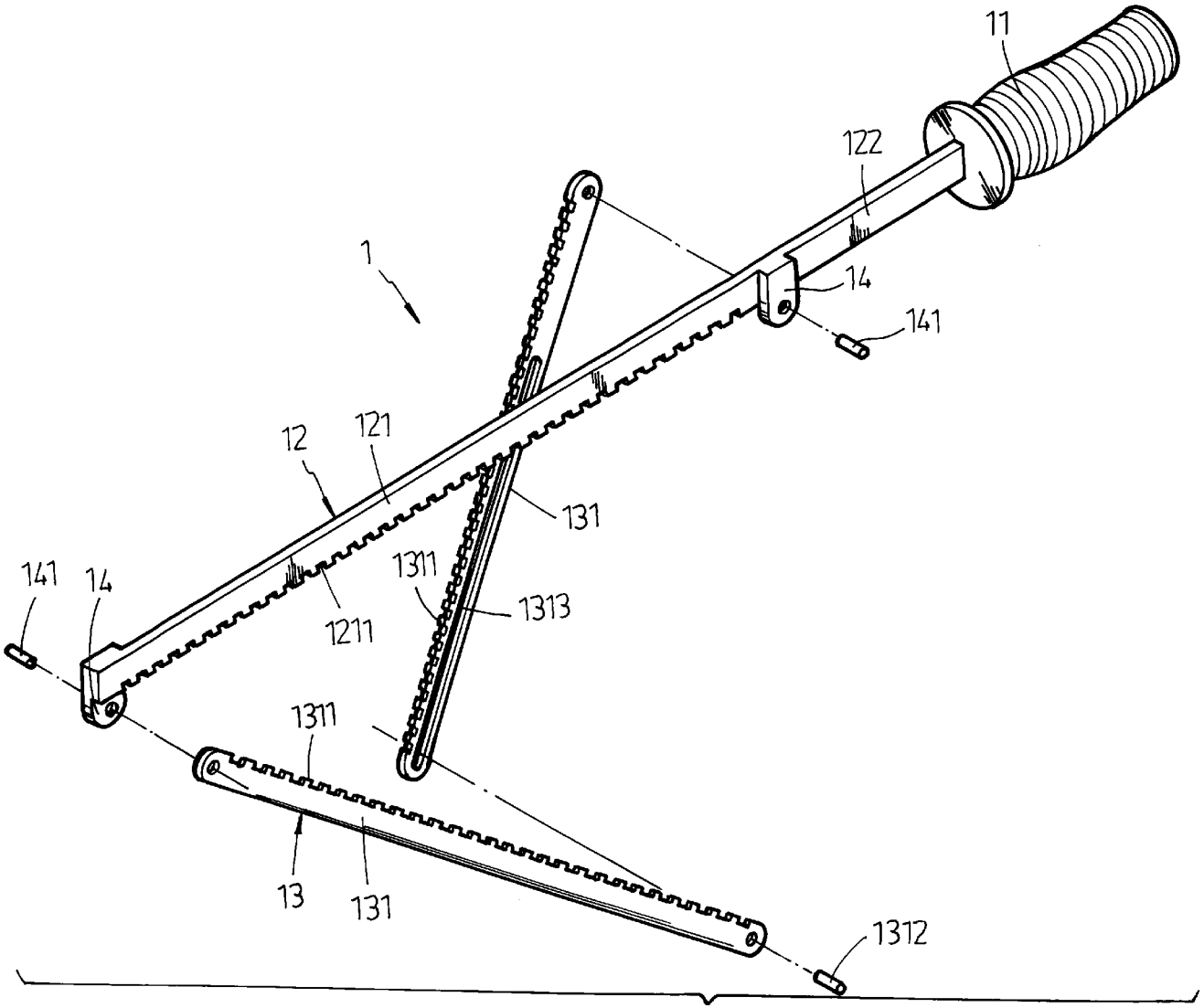
FIG. 2 is an exploded view of the bubble blowing device of the first embodiment of the present invention.
Figure 3:
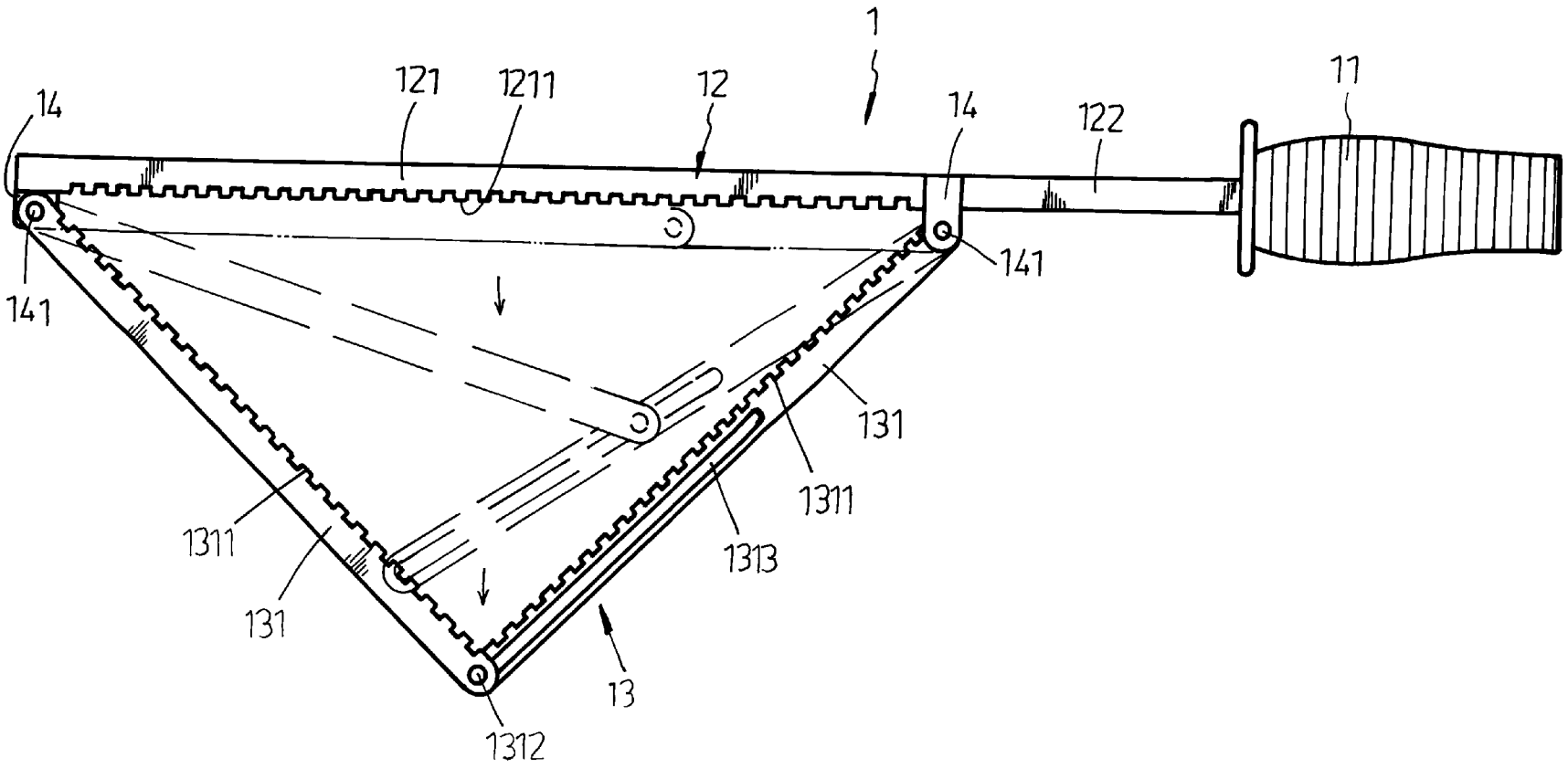
FIG. 3 illustrates the bubble blowing toy of the first embodiment of the present invention operated.
Figure 4:
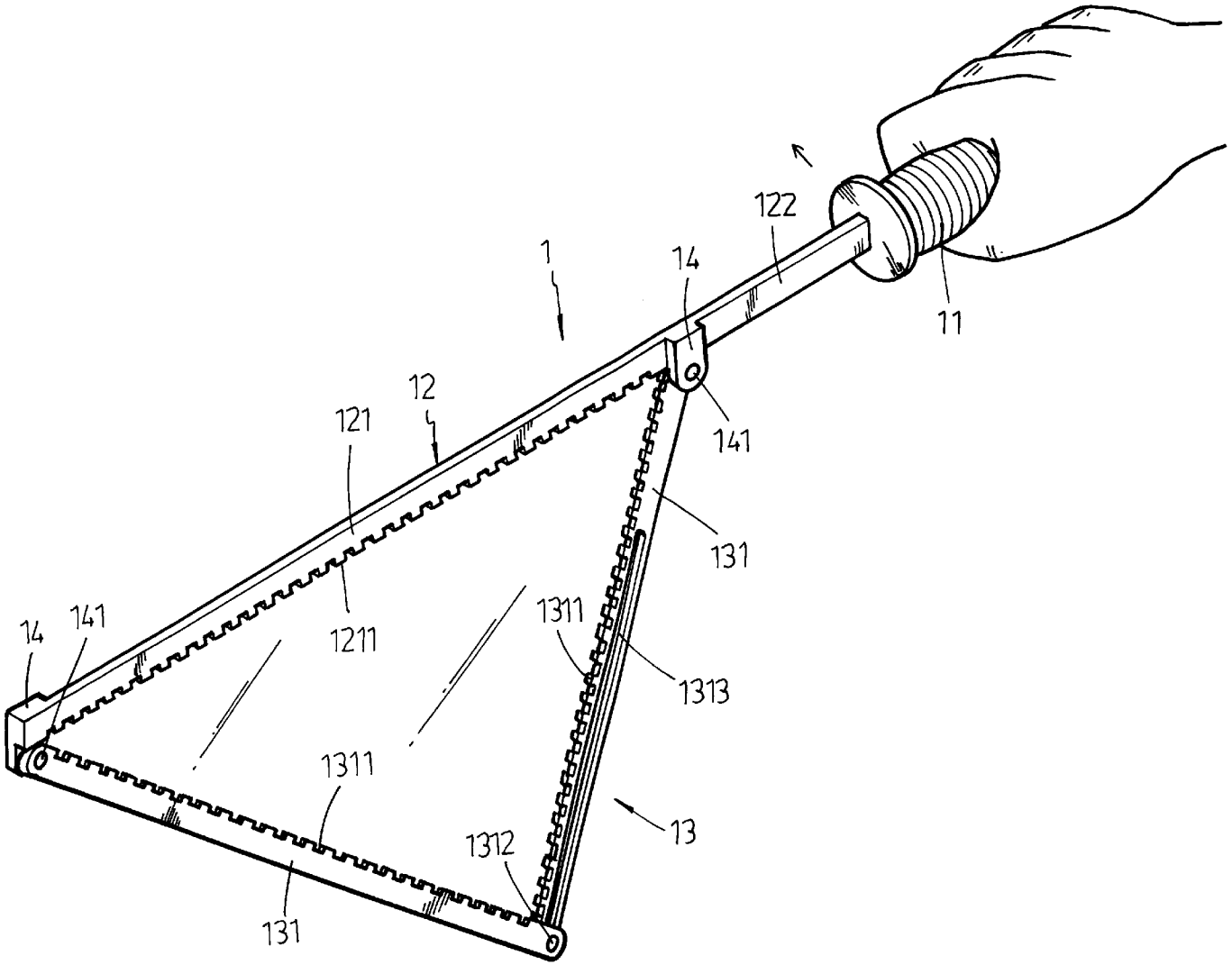
FIG. 4 illustrates the shutter means of the bubble blowing toy of the first embodiment of the present invention opened.
Figure 5:
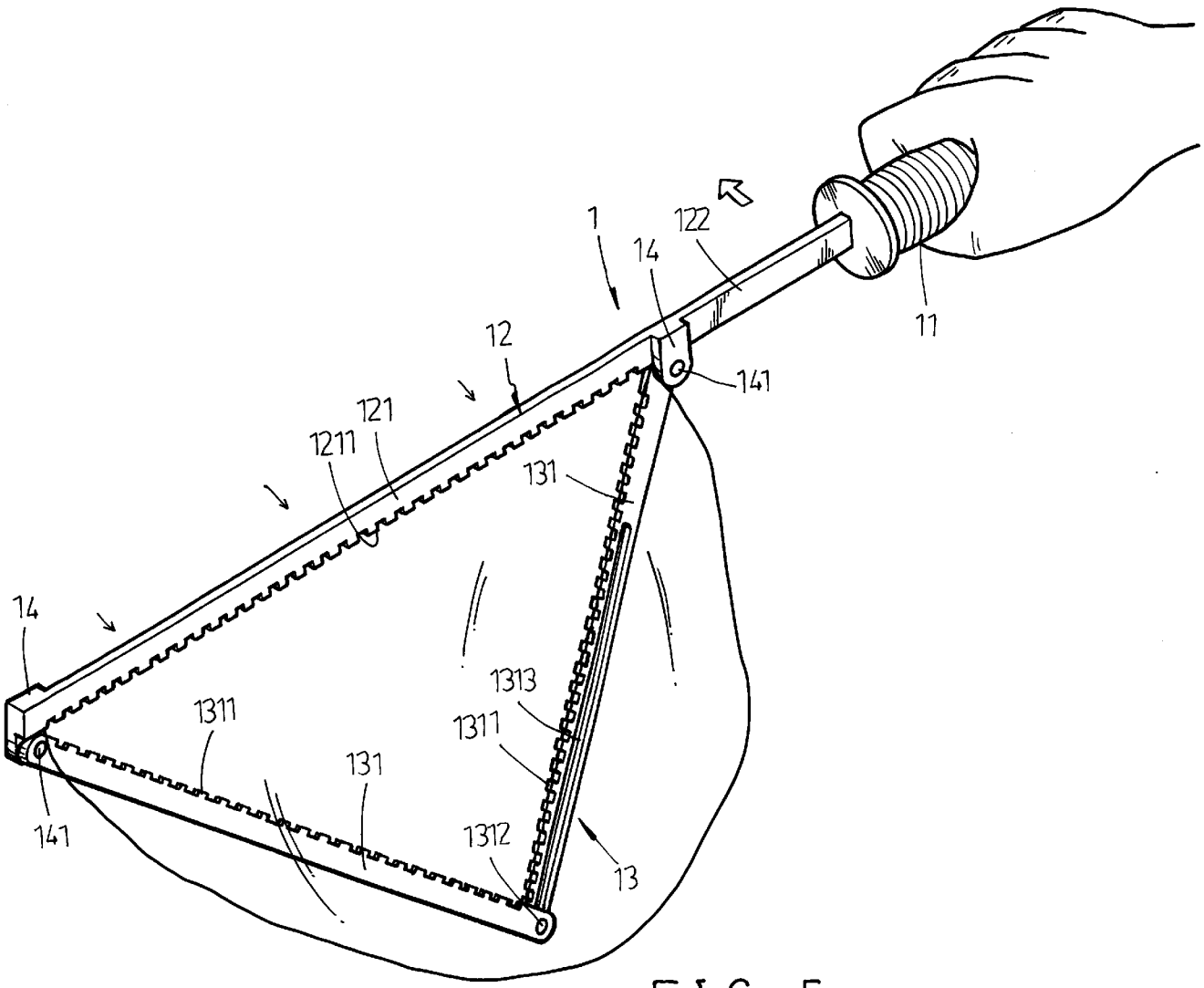
FIG. 5 illustrates a bubble solution membrane suspended from the bubble blowing device of the bubble blowing toy of the first embodiment of the present invention and blown into a big bubble.
Figure 6:
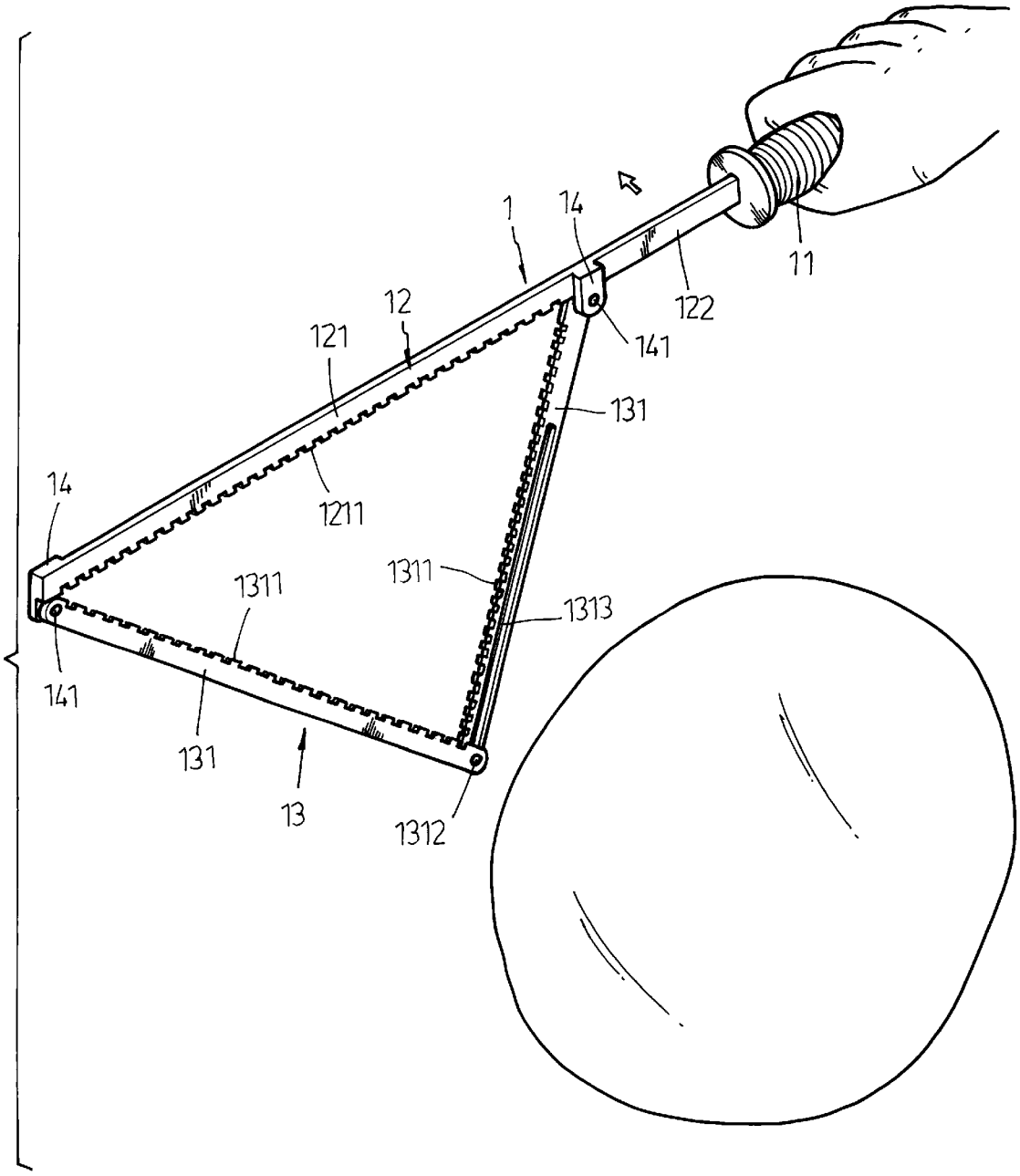
FIG. 6 is similar to FIG. 5 but showing the big bubble removed from the bubble blowing toy.

Referring to FIGS. 2 and 3 and FIG. 1 again, the bubble blowing device 1 is comprised of a hand grip 11 at one end, an elongated solution take-up arm 12, and shutter means 13 pivoted to the solution take-up arm 12. The solution take-up arm 12 is fixedly connected to the hand grip 11, comprising an elongated arm body 121, a neck 122 connected between the arm body 121 and the hand grip 11, and two lugs 14 integral with two opposite ends of the arm body 121. The neck 122 keeps the arm body 121 away from the hand grip 11, enabling the arm body 121 and the shutter means 13 to be completely dipped in the solution when the bubble blowing device 1 is closed and inserted through the opening 21 into the solution container 2. The arm body 121 has a serrated portion 1211 longitudinally disposed at one side for taking up the bubble solution from the solution container 2 efficiently.

The shutter means 13 can be variously embodied. In FIGS. from 1 through 6, the shutter means 13 is shown comprised of two shutter arms 131 coupled together. The shutter arms 131 each have a serrated portion 1311 longitudinally disposed at one side facing the serrated portion 1211 of the arm body 121 of the solution take-up arm 12, a first end respectively pivoted to the lugs 14 at the solution take-up arm 12 by a respective pivot 141, and a second end coupled to each other by a slip joint. The slip joint is comprised of an elongated slot 1313 longitudinally provided at the second end of one shutter arm 131, and a pivot 1312 fixedly fastened to the second end of the other shutter arm 131 and moved in the elongated slot 1313.

Figure 9:
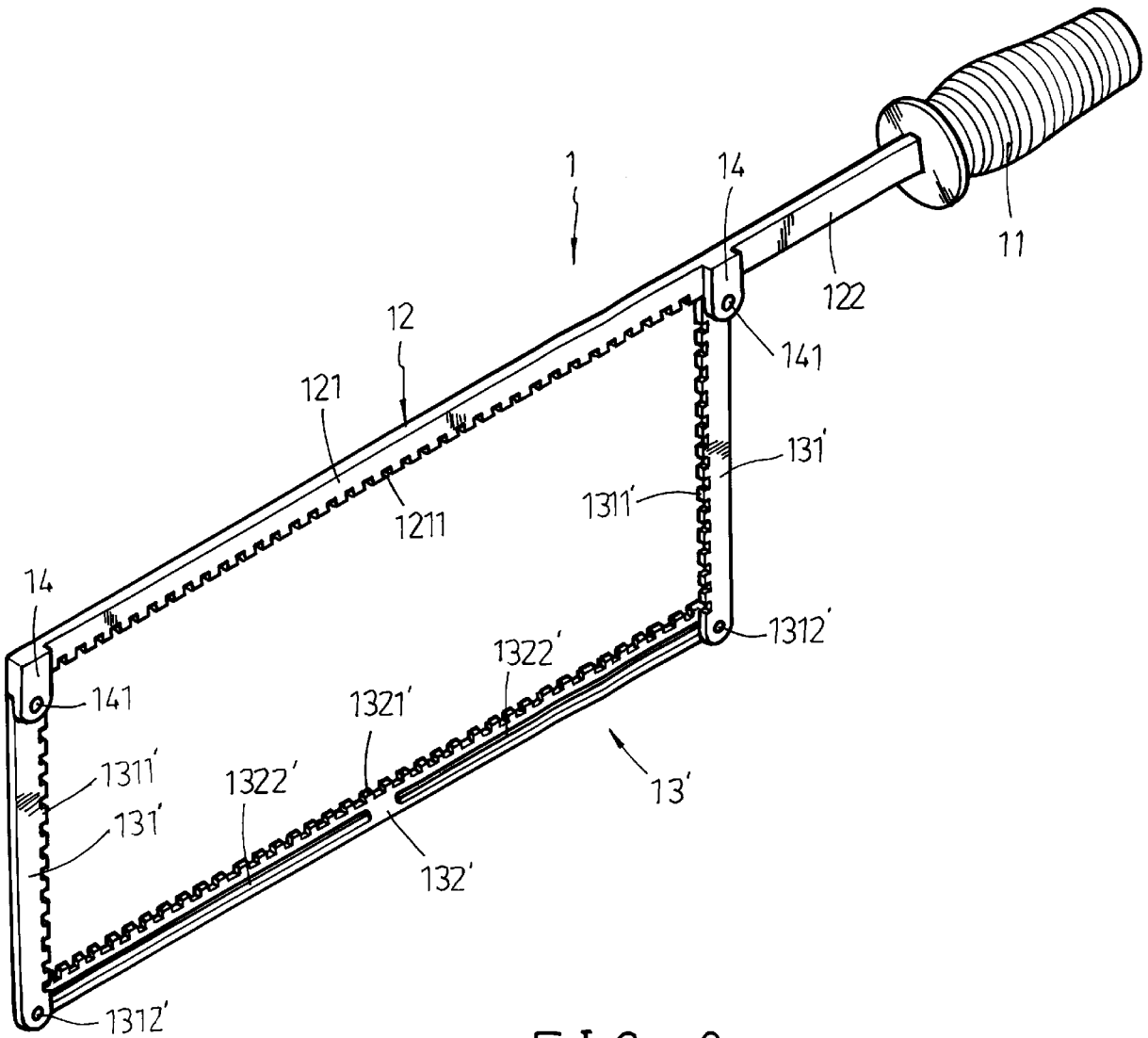
FIG. 9 is a perspective view of a bubble blowing toy according to a fourth embodiment of the present invention.
Figure 10:
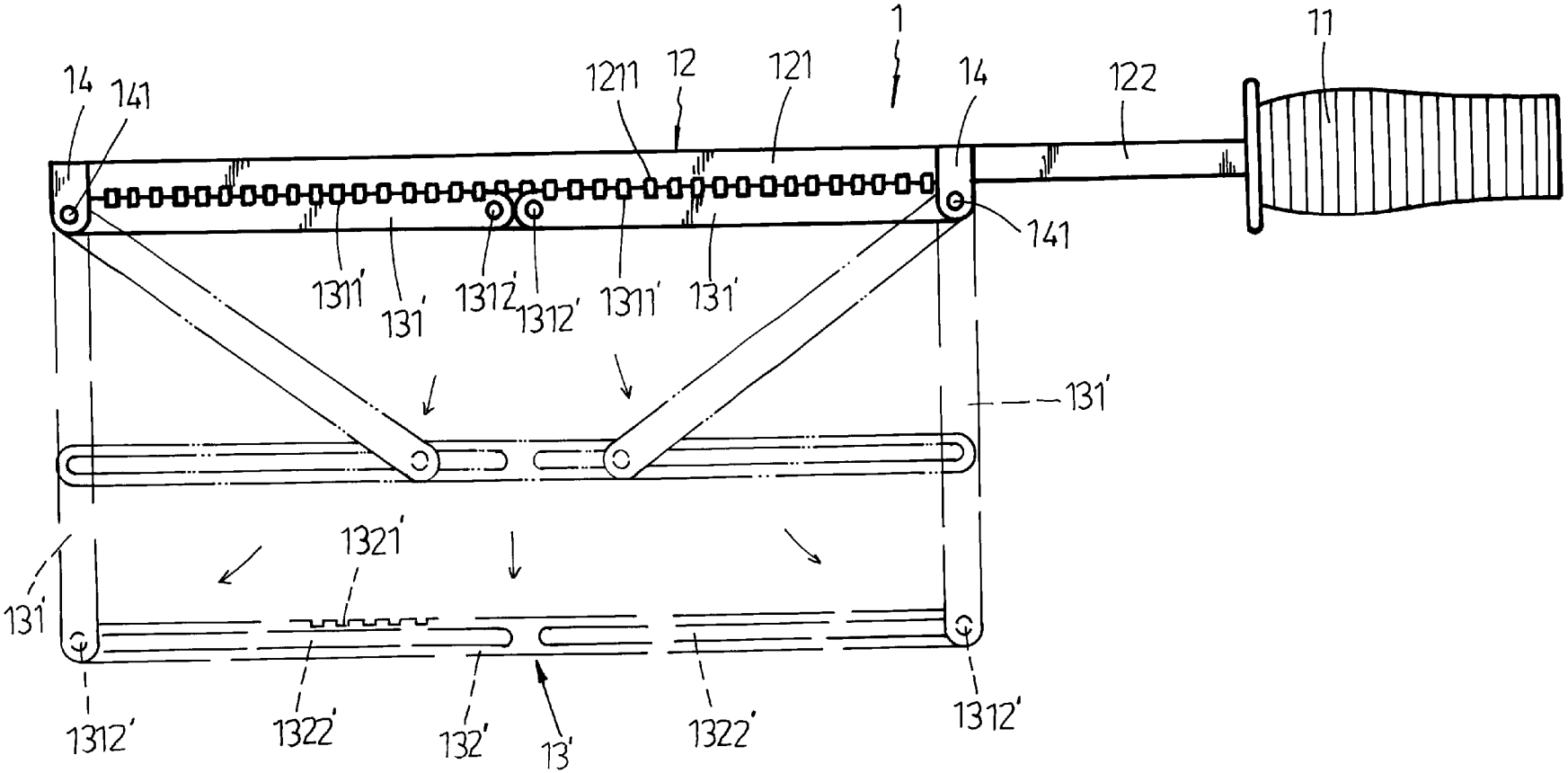
FIG. 10 illustrates the bubble blowing toy of the fourth embodiment of the present invention operated.

Referring to FIGS. 9 and 10, the shutter means 13' is shown comprised of two pivoting arms 131', and a guide arm 132'. The guide arm 132' is disposed in parallel to the arm body 121 of the solution take-up arm 12, having a serrated portion 1321' longitudinally disposed at one side facing the serrated portion 1211 of the arm body 121 of the solution take-up arm 12 and two longitudinally aligned sliding slots 1322'. The pivoting arms 131' each have one end respectively pivotably connected to the lugs 14 at the solution take-up arm 12 by a respective pivot 141, an opposite end respectively movably coupled to the sliding slots 1322' of the guide arm 132' by a respective pivot 1312', and a serrated portion 1311' longitudinally disposed at an inner side facing to each other. When the shutter means 13' is opened, the guide arm 132' with the pivoting arms 131' and the arm body 121 of the solution take-up arm 12 define a space for suspending a bubble solution membrane for blowing into a big bubble.

Referring to FIGS. from 1 through 3 and FIGS. 9 and 10 again, when the shutter means 13 or 13' is closed, it is closed attached to the solution take-up arm 12, enabling the bubble blowing device 1 is closed and inserted through the opening 21 into the solution container 2 to take up the bubble solution. When the bubble blowing device 1 is removed from the solution container 2 and the shutter means 13 or 13' is opened, a bubble solution membrane is suspended in the space defined by the solution take-up arm 12 and the shutter means 13 or 13' for blowing into a big bubble.

Referring to FIGS. 3 and 10 again, when the bubble blowing device 1 is removed from the solution container 2, it is held in horizontal and rotated, enabling the shutter means 13 or 13' to be suspended from the solution take-up arm 12 at the bottom. When the shutter means 13 or 13' is turned to the bottom side, it is immediately forced by its gravity weight to move to the opened position. On the contrary, when the shutter means 13 or 13' is turned to the top side above the solution take-up arm 12, it immediately returns to the closed position.

Referring to FIGS. from 4 through 6, when a bubble solution membrane is suspended in the space within the shutter means 13 and the arm body 121 of the solution take-up arm 12, the bubble blowing device 1 is moved in the air by hand, causing the bubble solution membrane to be blown into a big bubble.

Figure 7:
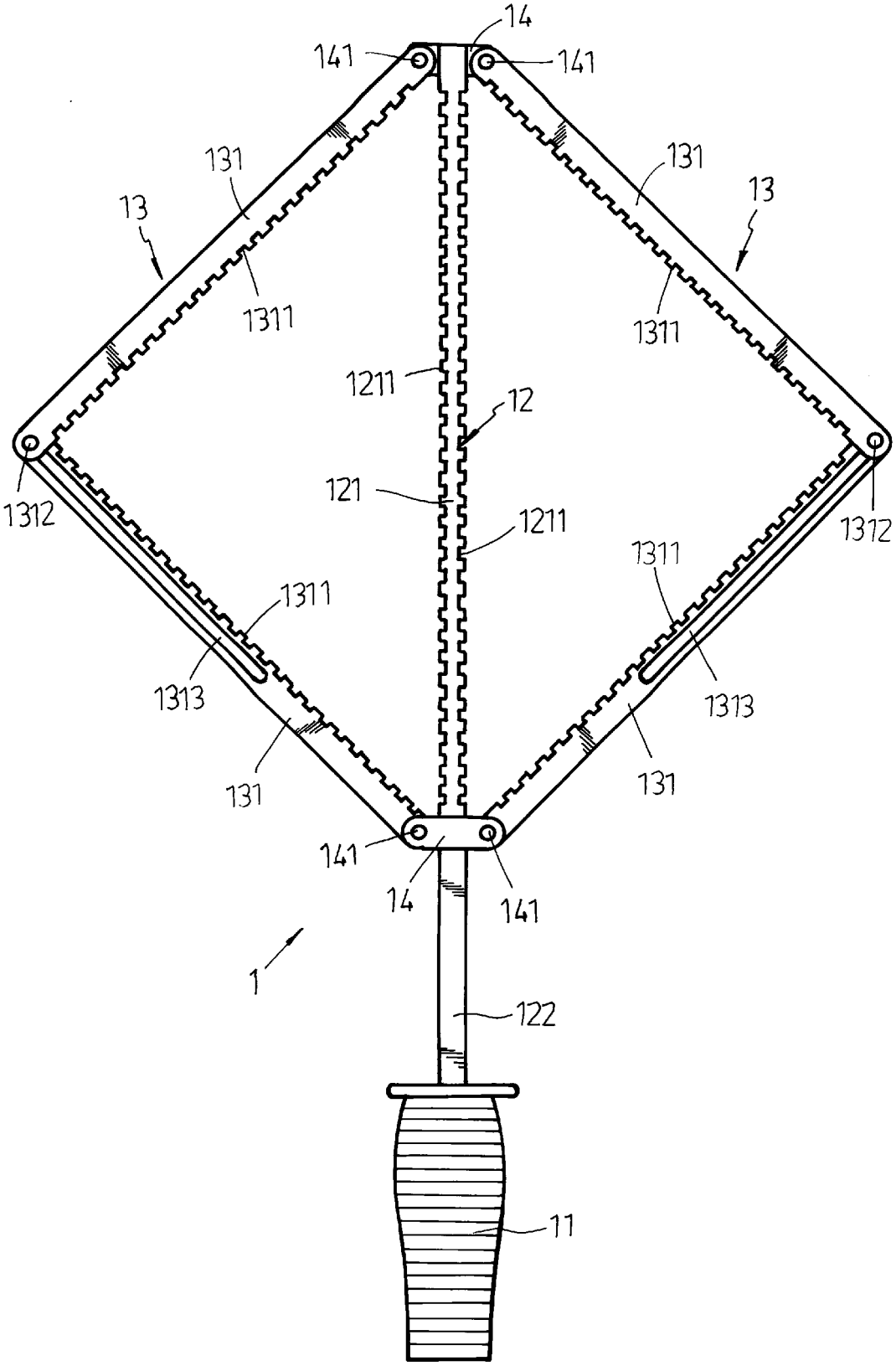
FIG. 7 is a perspective view of a bubble blowing toy according to a second embodiment of the present invention.

Referring to FIG. 7, two shutter means 13 may be symmetrically pivoted to the lugs 14 of the solution take-up arm 12 for producing two big bubbles at a time. According to this embodiment, the opening 21 of the solution container 2 must be made relatively bigger.

Figure 8:
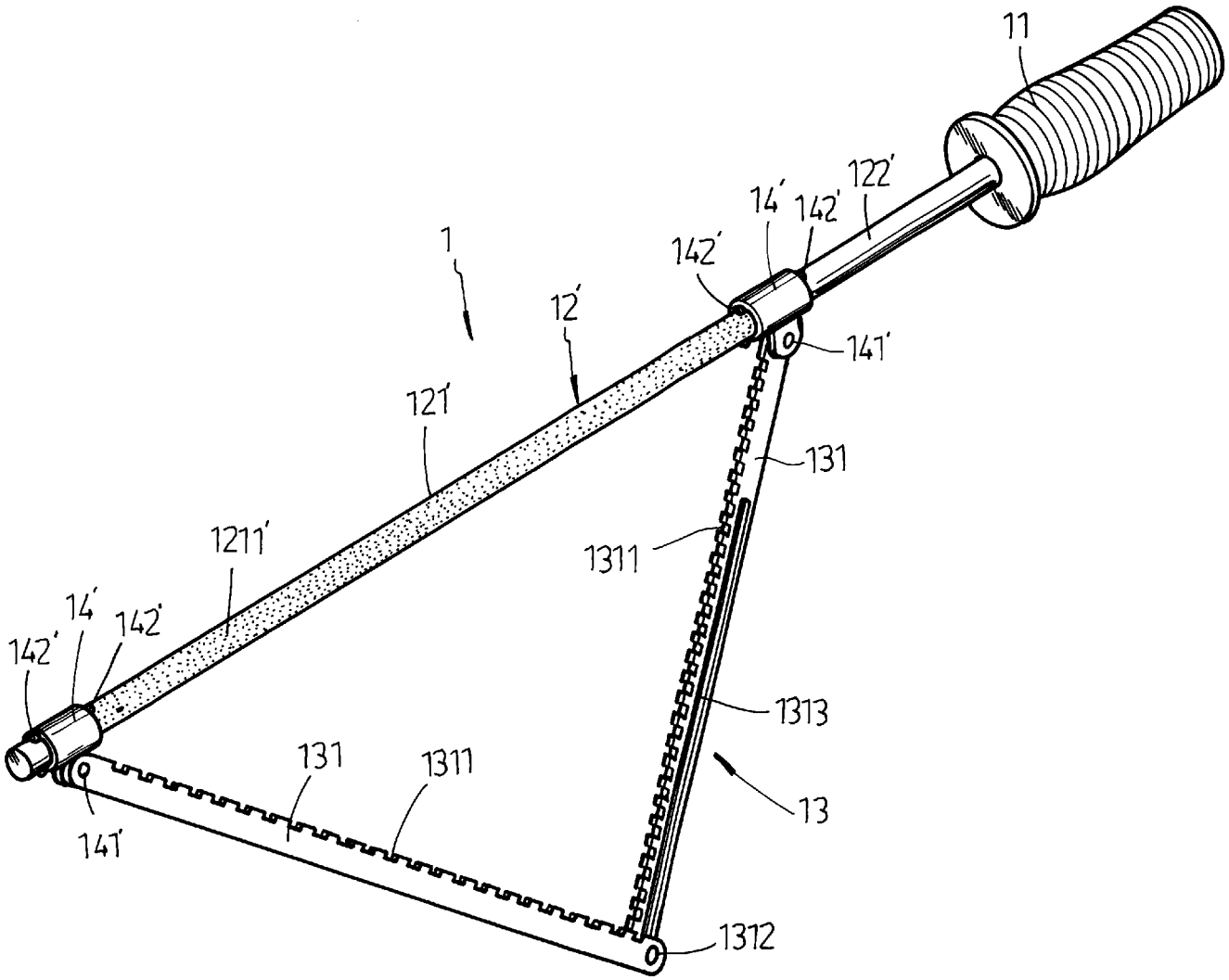
FIG. 8 is a perspective view of a bubble blowing toy according to a third embodiment of the present invention.

Referring to FIG. 8, the bubble blowing device 1 is comprised of a hand grip 11 at one end, an elongated solution take-up arm 12', and shutter means 13 pivoted to the solution take-up arm 12'. The solution take-up arm 12' is a round rod fixedly connected to the hand grip 11, comprising an elongated arm body 121', a neck 122' connected between the arm body 121' and the hand grip 11, and two barrel 14' mounted on the arm body 121' and retained to the two opposite ends of the arm body 121' by locating means 142'. The shutter means 13 is pivoted to the barrels 14' by pivots 141'. The arm body 121' is covered with a sleeve 1211' having a coarse outside wall. The operation of this embodiment is similar to the embodiment shown in FIGS. from 1 through 6.

It is to be understood that the drawings are designed for purposes of illustration only, and are not intended as a definition of the limits and scope of the invention disclosed.

What the invention claimed is:

1. A bubble blowing toy comprising a solution container holding a solution, and a bubble blowing device adapted to take up the solution from said solution container and to let the received solution be blown into a big bubble, wherein said bubble blowing device comprises: a hand grip at one end; an elongated solution take-up arm connected to said hand grip; and at least one shutter means respectively pivoted to said solution take-up arm, said solution take-up arm comprising an elongated arm body and a neck connected between said arm body and said hand grip, said at least one shutter means each comprising a first shutter arm and a second shutter arm coupled together, said first and second shutter arms each having a first end respectively pivoted to two opposite ends of said arm body of said solution takeup arm by pivot means and a second end pivoted to each other by a slip joint, wherein said slip joint comprises an elongated sliding slot longitudinally provided in said first shutter arm, and a pivot pin fixedly fastened to an end of said second shutter arm and movably engaged with the elongated sliding slot of said first shutter arm.

2. The bubble blowing toy of claim 1 wherein said bubble blowing device comprises two shutter means bilaterally pivoted to two opposite ends of the arm body of said elongated solution take-up arm.

3. The bubble blowing toy of claim 1 wherein the arm body of said elongated solution take-up arm has a serrated portion longitudinally disposed at one side facing said at least one shutter means, and the shutter arms of each of said at least one shutter means each have a serrated portion longitudinally disposed at one side facing the serrated portion of the arm body of said elongated solution take-up arm.

4. The bubble blowing toy of claim 1 wherein the arm body of said elongated solution take-up arm is covered with a sleeve having a coarse outside wall, and the shutter arms of each of said at least one shutter means each have a serrated portion longitudinally disposed at one side facing the arm body of said elongated solution take-up arm.

5. The bubble blowing toy of claim 1 wherein said at least one shutter means each comprise two pivoting arms, and a guide arm, said guide arm being disposed in parallel to the arm body of said solution take-up arm and having a serrated portion longitudinally disposed at one side facing the arm body of said solution take-up arm and two longitudinally aligned sliding slots, said pivoting arms each having one end respectively pivotably connected to two opposite ends of the arm body of said solution take-up arm by a respective pivot, an opposite end respectively movably coupled to the sliding slots of said guide arm by a respective pivot, and a serrated portion longitudinally disposed at an inner side facing to each other.

* * * * *